US006959824B1

(12) United States Patent
Alperson

(10) Patent No.: US 6,959,824 B1
(45) Date of Patent: Nov. 1, 2005

(54) RETAILING DISPLAY RACK WITH ADJUSTABLE DISPLAY ARM

(76) Inventor: Joel Alperson, 10320 J St., Omaha, NE (US) 68127

( * ) Notice: Subject to any disclaimer, the term of this patent is extended or adjusted under 35 U.S.C. 154(b) by 184 days.

(21) Appl. No.: 10/696,232

(22) Filed: Oct. 29, 2003

Related U.S. Application Data

(60) Provisional application No. 60/487,300, filed on Jul. 15, 2003.

(51) Int. Cl.[7] ..... A47B 43/00; A47B 53/00
(52) U.S. Cl. ..... 211/193; 211/1.3
(58) Field of Search ..... 211/193, 1.3, 187, 211/103, 190, 189, 175, 207

(56) References Cited

U.S. PATENT DOCUMENTS 4,056,196 A * 11/1977 Brauning ..... 211/207
4,127,196 A * 11/1978 Boucher ..... 211/207
4,380,298 A * 4/1983 Harig ..... 211/189
4,655,354 A * 4/1987 Cohen ..... 211/199
5,170,898 A * 12/1992 Katz et al. ..... 211/193
5,372,265 A * 12/1994 Monch ..... 211/187
5,660,637 A * 8/1997 Dodge ..... 211/175
5,894,946 A * 4/1999 Darnell et al. ..... 211/193
6,213,434 B1 * 4/2001 Reichanadter, Jr. ..... 211/207
6,302,036 B1 * 10/2001 Carson et al. ..... 211/175
6,769,556 B1 * 8/2004 Holscher ..... 211/193
6,796,446 B2 * 9/2004 Segall et al. ..... 211/207
6,848,589 B2 * 2/2005 Wood ..... 211/189

* cited by examiner

*Primary Examiner*—Hugh B. Thompson, II
(74) *Attorney, Agent, or Firm*—G. Brian Pingel; Camille L. Urban

(57) ABSTRACT

A retail display rack having vertically adjustable upper and lower display arms associated with a tubular housing structure that is vertically oriented for mounting the upper and lower arms thereon at selectable heights.

10 Claims, 5 Drawing Sheets

RETAILING DISPLAY RACK WITH ADJUSTABLE DISPLAY ARM

RELATED U.S. APPLICATION DATA

Provisional application No. 60/487,300, filed on Jul. 15, 2003.

BACKGROUND OF THE INVENTION

1. Field of the Invention

The present invention relates in general to retailing display racks that typically are utilized for holding garments or other material for viewing by customers and more specifically relates to display racks having vertically adjustable upper and lower display arms.

2. Description of the Prior Art

A wide variety of retailing display racks are known in the prior art. Furthermore, the use of display racks having vertically separated display arms also are not new. Nevertheless, such prior art display racks have been deficient in their construction in that they do not provide a reliable and relatively simple method for attachment and support of the display arms.

The present invention is designed to avoid the deficiencies of the prior art structures and provide a display rack with upper and lower display arms that can be readily and easily attached and adjusted in height as desired.

SUMMARY OF THE INVENTION

The present invention provides an improved retailing display rack that is formed of a base member, a tubular housing member that extends upwardly from said base member and has an inner channel member that defines a pair of spaced apart chambers in said housing member for receiving a pair of display arm members. At least one side of the tubular housing is provided with an uprightly extending slot and said channel member includes multi-interrupted slots in registry with said upright slot. A horizontally extending lower arm has one end that extends through said aligned slot and is removably attachable to said channel member by means of said multi-interrupted slots.

The display rack includes a pair of display support members associated with said housing member and each of which is provided with a horizontal upper arm located above the tubular housing upper end and a downwardly depending elongated leg that is slidably received in one of the chambers in said housing member. Positioning means are associated with each of said support member legs for coacting with said housing member to semi-permanently selectively secure each of said legs in said housing member at a desired vertical height.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference should be made to the claims herein for interpreting the breadth of the invention.

DETAILED DESCRIPTION OF THE PREFERRED EMBODIMENT

Figure 1:
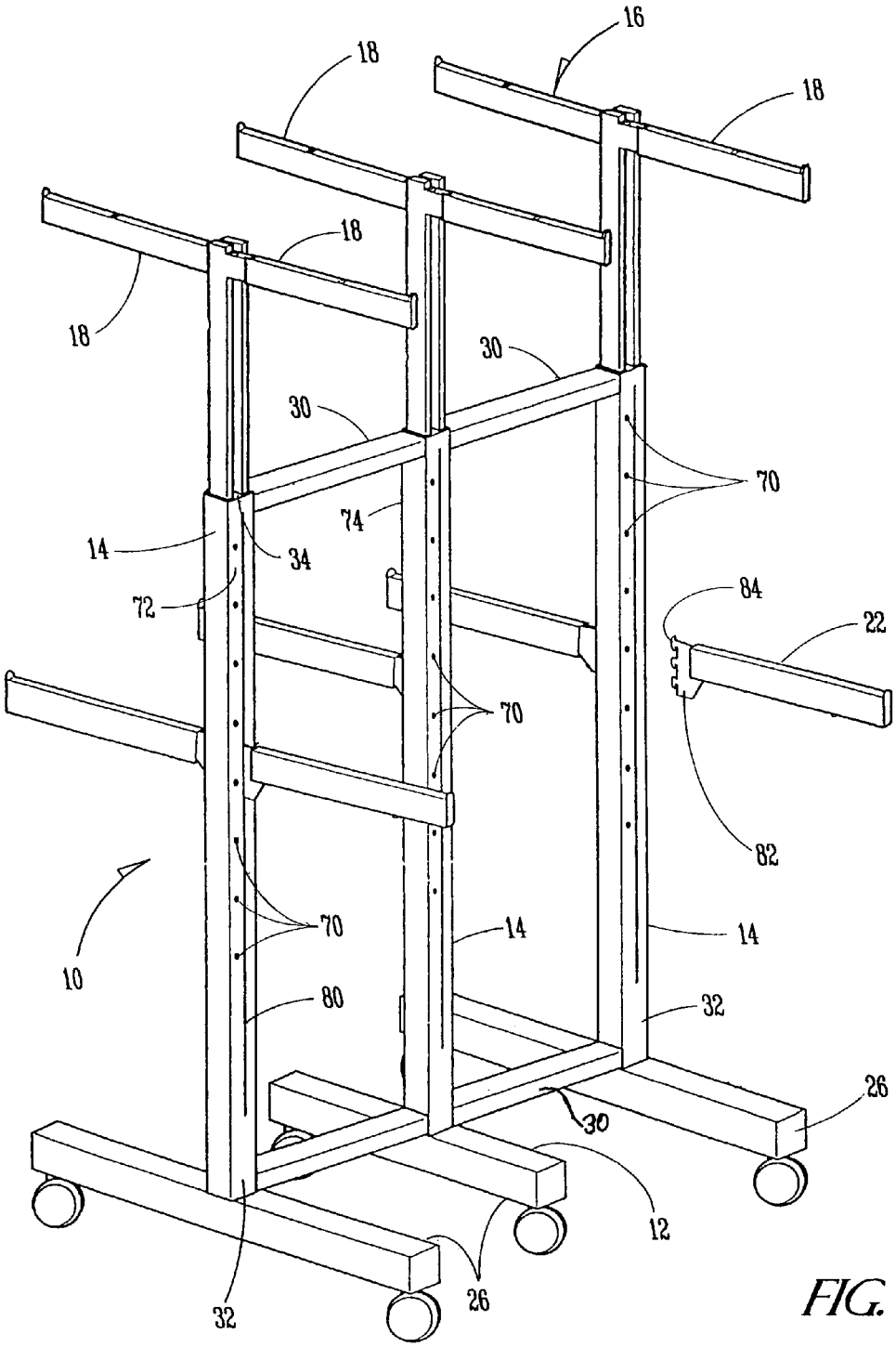
FIG. 1 is a front side perspective view of a preferred embodiment of an improved retailing display rack of the present invention that includes a base, a plurality of tubular housing members and upper and lower display arms.
Figure 4:
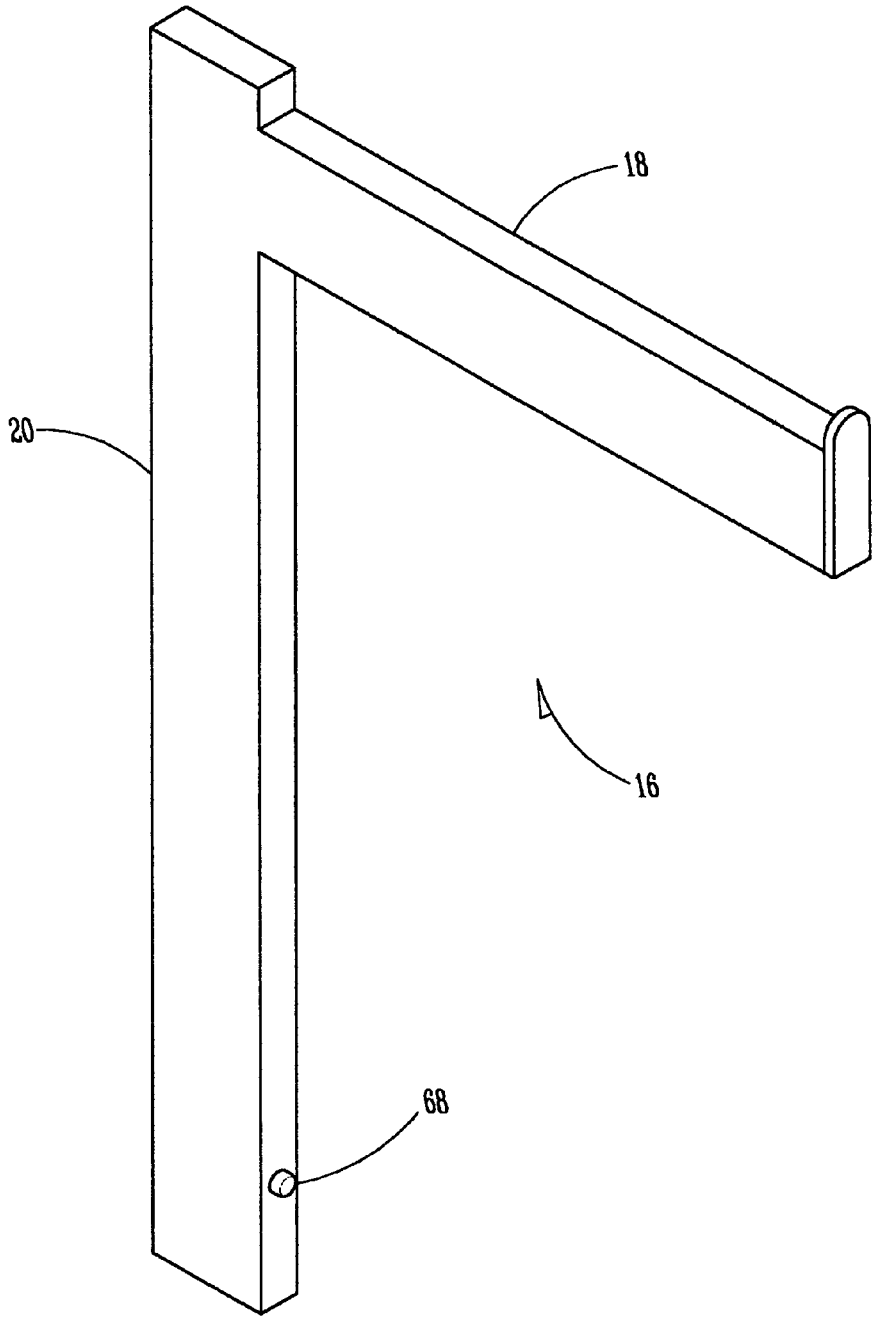
FIG. 4 is a perspective view of an upper display arm of the embodiment of FIG. 1.

Referring now to the drawings and with reference first to FIG. 1 a preferred embodiment of the retailing display rack of the present invention is shown at 10, which rack is adapted to be utilized for the displaying of merchandise in a multi-level environment. The rack 10 includes a base 12, a plurality of tubular housing members 14 extending vertically upward from the base 12, a plurality of display support members 16 each having a horizontal upper arm 18 and a downwardly depending leg 20 (see FIG. 4) for positioning within an associated housing member 14 and a plurality of lower arms 22 that are removably attachable to the housing members 14, all as will be described below.

The base 12 includes three horizontally aligned and parallel base members 26 that are supported off the ground by associated casters 28 located at each end of the base members 26. The housing members 14 are connected together by spanning struts 30 that bridge between the housing members 14.

To form a frame type arrangement, the spanning struts 30 are connected to bottom ends 32 of the tubular housing members 14, with one of the housing members 14 associated with one of the base members 26. As can be seen from FIG. 1, the housing members 14 are elongated to extend upwardly from the base 12 and have open upper ends 34.

Figure 2:
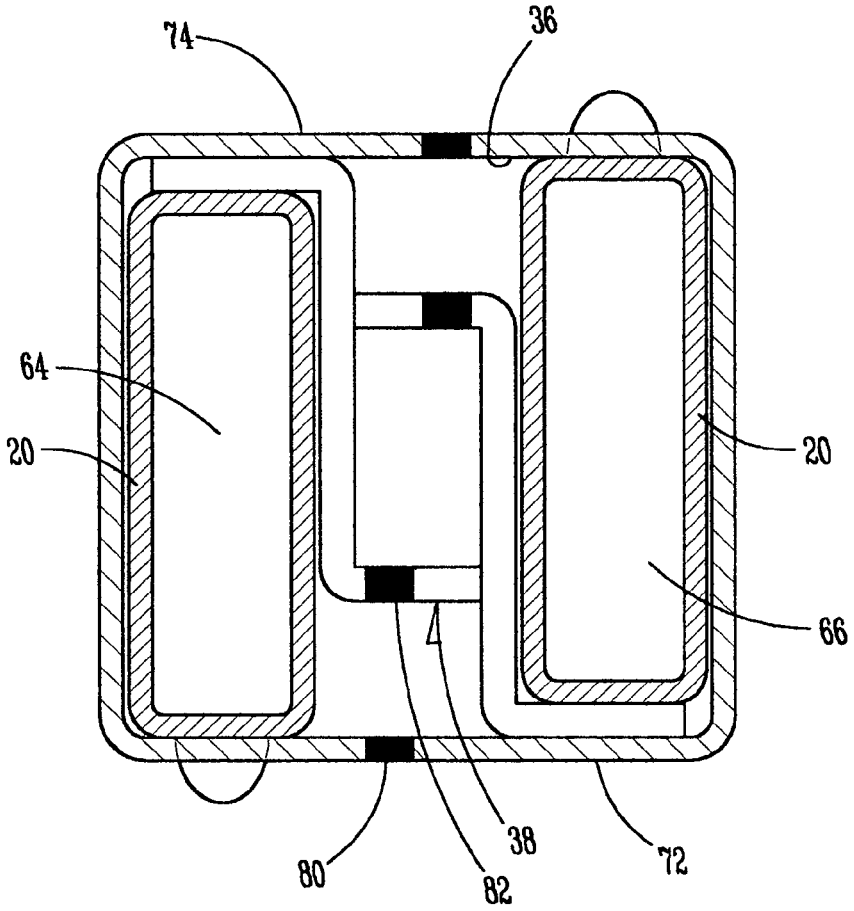
FIG. 2 is a cross-sectional view of the tubular housing member of FIG. 1.

Referring now to FIG. 2, which depicts a cross-sectional view of one of the housing members 14, it can be seen that the housing members 14 have a shape that is generally rectangular in configuration and an interior cavity 36 that preferably extends the entire length of the members 14. Located within the cavity 36 is an elongated channel member 38 that, as indicated in FIG. 3, is formed of two generally "Z" shaped sections 40 and 42.

Figure 3:
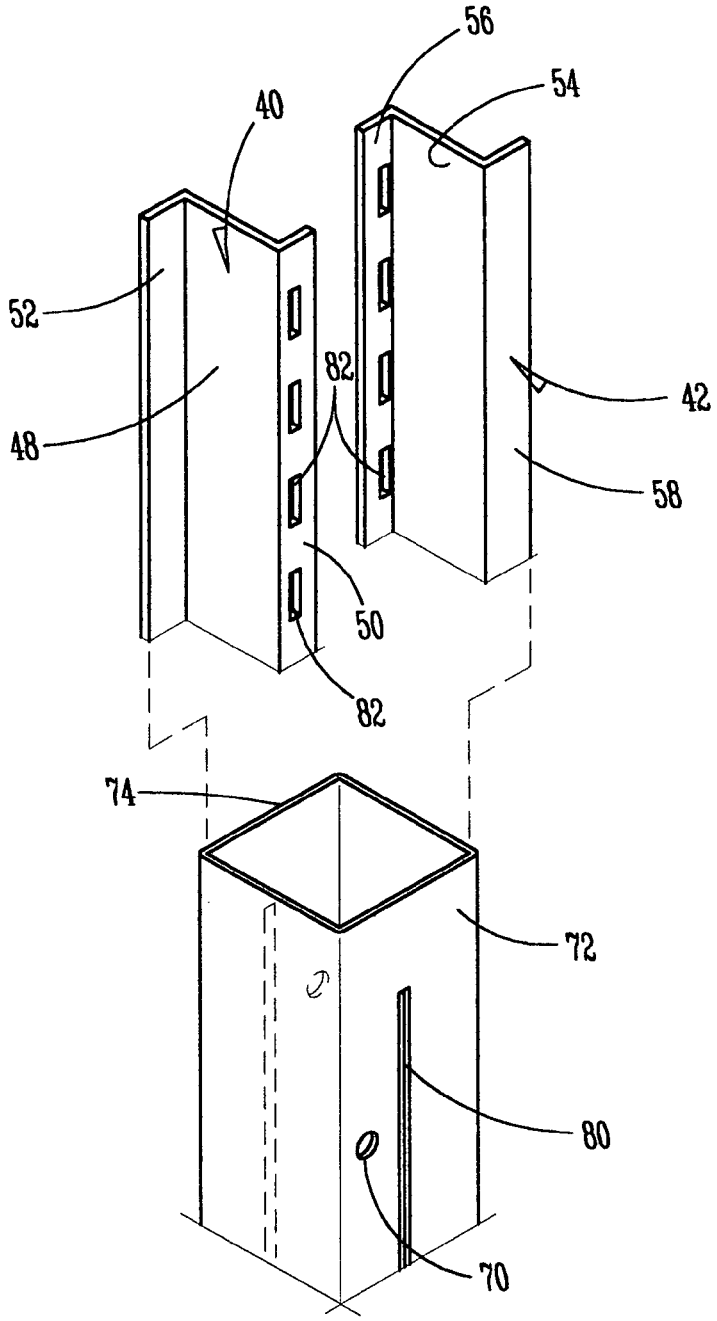
FIG. 3 is an exploded view of a portion of the tubular housing member of FIG. 1.

Referring now to both FIGS. 2 and 3, the channel member section 40 includes a planar midportion 48 that terminates at either side with oppositely directed flanges 50 and 52 to form the generally "Z" shaped configuration. Likewise, the channel member section 42 includes a midportion 54 having oppositely directed flanges 56 and 58. As illustrated best by FIG. 2, the sections 40 and 42 are welded together so that the flange 50 of the section 40 is welded to the midportion 54 of the section 42, and the flange 56 of the section 42 is welded to the midportion 48 of the section 40.

To secure the channel member 38 within the housing member cavity 36, the flanges 52 and 58 of the sections 40 and 42 respectively are welded to the interior wall of the cavity 36 to hold the channel member 38 in position within the cavity 36. With the channel member 38 secured within the cavity 36, the cavity is divided into a pair of spaced apart vertically aligned chambers 64 and 66 that are adapted to individually, slidably receive one of the legs 20 of one of the support members 16 as further indicated in FIG. 2. Thus, two support members 16 are associated with each of the housing members 14 and, preferably, are assembled therewith so that the upper arms 18 of the two support members 16 of one housing member 14 extend outwardly in opposite directions.

To set the height of the support members 16 with respect to the housing members 14, each support member leg 20 includes a spring biased pin 68, as is well-known in the art, which pin 68 is sized to being received within one of a plurality of vertically aligned, spaced apart apertures 70 that are located in opposite sides 72 and 74 of each housing member 14. Consequently, depending upon which of the apertures 70 the pin 68 is positioned in, the height of the associated support member 16 will be determined.

As shown in FIG. 1, for purposes of illustration only, eight apertures 70 are formed in each of the housing members 14 which provide for eight different positions in which the support members 16 can be arranged. Furthermore, by placing two support members 16 in each housing member 14, with the arrangement of the display rack 10 as shown in FIG. 1 that includes three housing members 14, a total of six upper display arms 18 are provided by the rack 10.

Referring again to FIG. 1, the housing members 14 are also adapted to support the lower arms 22 in an adjustable arrangement as will now be described. In addition to the apertures 70, each of the housing member sidewalls 72 and 74 include a vertically aligned elongated, preferably continuous slot 80 adjacent the apertures 70. In contrast to the continuous slots 80, the channel member section flanges 50 and 56 include a plurality of vertically aligned multi-interrupted slots 82 that are horizontally aligned with the slots 80.

Figure 5:
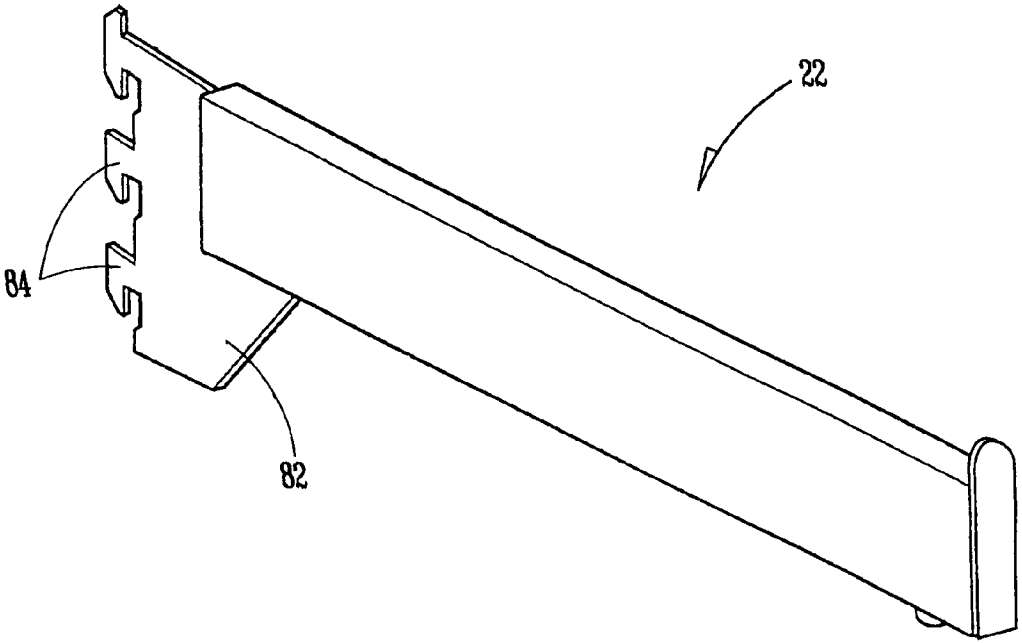
FIG. 5 is a perspective view of a lower display arm of the embodiment of FIG. 1.

Referring now to FIG. 5, the lower arms 22 each include an inner end 82 that terminates in one or more attachment fingers 84 and again for purposes of illustration herein, there are three such attachment fingers 84 shown. The lower arm inner end 82 is sized for fitting through the slots 80 so that the fingers 84 can be received within the multi-interrupted slots 82 and retained therein for securing the lower arms 22 to the channel members 14. Preferably, the multi-interrupted slots are formed in the flanges 50 and 56 corresponding to the entire length of the slots 80 so that the lower arms can be arranged in association with the housing members 14 either near the base 12 or in a position elevated therefrom as desired.

It can thus be seen that the present invention as described provides a retailing display rack that includes vertically adjustable upper and lower arms to enable a retailer to arrange materials to be displayed at a variety of different elevations. It is to be understood that the terminology that has been used herein is intended to be in the nature of words of description rather than of limitation and the foregoing description of the present invention is solely for illustrative purposes.

Many modifications and variations of the present invention are possible in light of the above teachings. For example, there are many different alternatives for the construction of the upper and lower support arms and the connection of the lower support arms to the housing members. Also, a variety of different types of arrangements of housing members associated with the base are available and the specific arrangement disclosed for the components of the present invention are only one example of the type of arrangement that can be utilized. Therefore, the foregoing description is not to be taken as definitive of the scope of the invention; but rather that which is regarded as the invention is set forth in the following claims.

What is claimed is:

1. An retailing display rack comprising:

(a) a base member;

(b) at least one elongated, vertically aligned tubular housing member with a lower end attached to said base member and an open upper end located above said base member, said housing member being provided with at least one uprightly extending slot;

(c) an elongated channel member positioned within said housing member along the vertical axis thereof a define a pair of spaced apart vertically aligned chambers in said housing member and having multi-interrupted slots in horizontal alignment with said upright slot;

(d) a pair of display support members associated with said housing member, each of which is provided with a horizontal upper arm located above the said housing member upper end and a downwardly depending leg that is slidably received in one of said chambers in said housing member;

(e) positioning means associated with each of said support member legs for coacting with said housing member to semi-permanently secure said legs in said housing member at desired vertical heights; and (f) a horizontally extending lower arm removably attachably extending through said upright slot and having at least one finger for coacting with at least one of said multi-interrupted slots to semi-permanently attach said arm to said housing member.

2. The retailing display rack as described in claim 1, wherein at spaced apart intervals on said base member, there are attached a plurality of said tubular housing members.

3. The retailing display rack as described in claim 2, wherein said rack further includes bridge members extending between said tubular housing members and attached thereto to provide a frame type construction for said display rack.

4. The retailing display rack as described in claim 1, wherein said channel member comprises two generally "Z" shaped sections that are fastened together to form a generally rectangularly shaped center portion having opposite sidewalls in which said multi-interrupted slots are formed.

5. The retailing display rack as described in claim 4, wherein each of said channel member sections includes a planar midportion having opposite side edges, wherein one of said opposite side edges terminates in a flange that is attached to said housing member and the other of said opposite side edges terminates in a flange in which said multi-interrupted slots are formed.

6. The retailing display rack as described in claim 5, wherein said channel member is formed with the slotted flange on one of the channel member sections affixed to the planar midportion of the other channel member section.

7. The retailing display rack as described in claim 1, wherein said housing member is provided with at least two uprightly extending slots that extend along a major portion of the length of said housing member.

8. The retailing display rack as described in claim 1, wherein said positioning means include a spring biased pin associated with each of said support member legs and a plurality of vertically spaced apart apertures formed in said housing member.

9. The improved retailing display rack as described in claim 1, wherein said housing member is of a substantially rectangular cross-sectional shape and said chambers in said housing member likewise have a generally rectangular cross-sectional shape.

10. The retailing display rack as described in claim 1, wherein said base member includes a set of casters to allow said display rack to be readily movable.

* * * * *